US011572609B2

(12) United States Patent
Holloway

(10) Patent No.: US 11,572,609 B2
(45) Date of Patent: Feb. 7, 2023

(54) METALLIC MATRIX COMPOSITE WITH HIGH STRENGTH TITANIUM ALUMINIDE ALLOY MATRIX AND IN SITU FORMED ALUMINUM OXIDE REINFORCEMENT

(71) Applicant: Parker Lodge Holdings LLC, Elmhurst, IL (US)

(72) Inventor: Scott Richard Holloway, Calgary (CA)

(73) Assignee: PARKER LODGE HOLDINGS LLC, Elmhurst, IL (US)

( * ) Notice: Subject to any disclaimer, the term of this patent is extended or adjusted under 35 U.S.C. 154(b) by 650 days.

(21) Appl. No.: 16/098,538

(22) PCT Filed: May 4, 2017

(86) PCT No.: PCT/CA2017/050542

§ 371 (c)(1),
(2) Date: Nov. 2, 2018

(87) PCT Pub. No.: WO2017/190245

PCT Pub. Date: Nov. 9, 2017

(65) Prior Publication Data

US 2019/0093202 A1 Mar. 28, 2019

Related U.S. Application Data

(60) Provisional application No. 62/331,576, filed on May 4, 2016.

(51) Int. Cl.
*C22C 14/00* (2006.01)
*C22C 21/00* (2006.01)
(Continued)

(52) U.S. Cl.
CPC ..... *C22C 32/0031* (2013.01); *B22F 3/23* (2013.01); *C22C 1/0458* (2013.01);
(Continued)

(58) Field of Classification Search
CPC ..... B22F 2301/40; B22F 2303/15
See application file for complete search history.

(56) References Cited

U.S. PATENT DOCUMENTS 4,909,842 A 3/1990 Dunmead et al.
2006/0032558 A1 2/2006 Holloway
(Continued)

FOREIGN PATENT DOCUMENTS

CA 2824988 A1 8/2012
WO 2012/108980 A1 8/2012
(Continued)

OTHER PUBLICATIONS

Zhang et al. "Mechanical Properties and Microstructure of AI2O3/TiAI in Situ Composites Doped with Cr and V2O5" Science of Sintering, 44, pp. 73-80 (Year: 2012).*
(Continued)

*Primary Examiner* — Anthony J Zimmer
*Assistant Examiner* — Dean Mazzola

(57) ABSTRACT

Metallic matrix composites include a high strength titanium aluminide alloy matrix and an in situ formed aluminum oxide reinforcement. The atomic percentage of aluminum in the titanium aluminide alloy matrix can vary from 40% to 48%. Included are methods of making the metallic matrix composites, in particular, through the performance of an exothermic chemical reaction. The metallic matrix composites can exhibit low porosity.

20 Claims, 2 Drawing Sheets

(51) Int. Cl.

| | |
|---|---|
| ***C22C 32/00*** | (2006.01) |
| ***C22C 1/04*** | (2006.01) |
| ***C22C 1/05*** | (2006.01) |
| ***B22F 3/23*** | (2006.01) |

(52) U.S. Cl.
CPC ..... *C22C 1/0491* (2013.01); *C22C 1/053* (2013.01); *C22C 1/058* (2013.01); *C22C 14/00* (2013.01); *C22C 21/003* (2013.01); *C22C 32/0036* (2013.01)

(56) References Cited

U.S. PATENT DOCUMENTS

| | | | | |
|---|---|---|---|---|
| 2009/0311123 | A1* | 12/2009 | Zhang | C22C 1/0491 75/235 |
| 2013/0180758 | A1* | 7/2013 | Holloway | B22D 11/005 174/128.1 |

FOREIGN PATENT DOCUMENTS

| | | | |
|---|---|---|---|
| WO | 2017/190243 | A1 | 11/2017 |
| WO | 2017/190245 | A1 | 11/2017 |
| WO | 2017/190246 | A1 | 11/2017 |
| WO | 2017/190247 | A1 | 11/2017 |

OTHER PUBLICATIONS

D. Horvitz et al. "In situ processing or dense AI2O3-Ti aluminide interpenetrating phase composites" Journal of the European Ceramic Society, 22, pp. 947-954 (Year: 2002).*

Y.F. Shen et al. "Properties and electronic structures of titanium aluminides-alumina composites from in-situ SHS process" Materials Science and Engineering A, 528, pp. 2100-2105 (Year: 2011).*

International Search Report dated Aug. 17, 2017 in respect of International Application No. PCT/2017/050542.

International Preliminary Report on Patentability dated Nov. 6, 2018 in respect of International Application No. PCT/2017/050542.

* cited by examiner

METALLIC MATRIX COMPOSITE WITH HIGH STRENGTH TITANIUM ALUMINIDE ALLOY MATRIX AND IN SITU FORMED ALUMINUM OXIDE REINFORCEMENT

CROSS-REFERENCE TO RELATED APPLICATIONS

This is a national stage application of International Application No. PCT/CA2017/050542 filed May 4, 2017, which claims priority to U.S. Patent Application No. 62/331,576 filed May 4, 2016, and the entire contents of each are hereby incorporated herein by reference.

FIELD

The present disclosure relates to metallic matrix composite materials, and in particular to metallic matrix composites made using exothermic reactions, including self-propagating high-temperature synthesis reactions.

INTRODUCTION

The following paragraphs are not an admission that anything discussed in them is prior art or part of the knowledge of persons skilled in the art.

Self-propagating high-temperature synthesis (SHS) is a method known to the art for making metallic compounds and metallic matrix composite materials by way of an exothermic reaction between blended powders of reactant materials, characterized by a rate of reaction and subsequent rate of heating which are sufficiently high to cause the reaction to self-propagate, and which can result in reaction products deemed useful for science and engineering applications.

In its simplest form, an SHS reaction can be said to occur according to the following chemical formula:

$$A+B \rightarrow AB-\Delta H,$$

where "A" and "B" are elements which combine to form chemical compound "AB" and the term ΔH is the heat of reaction, which can be calculated as follows:

$$\Delta H=\Sigma\Delta_f H_{PRODUCTS}-\Sigma\Delta_f H_{REACTANTS},$$

where ΔfH is the enthalpy of formation. For the chemical formula above, the value of ΔH can be calculated as:

$$\Delta H=\Delta_f H_{AB}-\Delta_f H_A-\Delta_f H_B,$$

and because the enthalpy of formation of elements is always zero, this equation can be reduced to:

$$\Delta H=\Delta_f H_{AB}.$$

For exothermic reactions the value of ΔH can be said to be less than zero, and to be equal to the amount of heat energy per mole of reactant released as a result of the reaction.

In order to understand whether or not a driving force exists for the reaction, it is generally necessary to evaluate the change in Gibbs free energy, which is related to the heat of the reaction, temperature and change in entropy by the equation:

$$\Delta G=\Delta H-T\Delta S.$$

In order for the driving force to exist, the value of ΔG must be less than zero, and in such cases the reaction can be said to be "spontaneous". The change in Gibbs free energy for the reaction can be calculated as:

$$\Delta G=\Sigma\Delta_f G_{PRODUCTS}-\Sigma\Delta_f G_{REACTANTS},$$

where $\Delta_f G$ is the Gibbs free energy of formation for the compounds in the reaction. For the reaction above, the change in Gibbs free energy can be calculated as:

$$\Delta_f G=\Delta_f G_{AB},$$

where "$\Delta_f G_{AB}$" is the Gibbs free energy of formation for the chemical compound "AB".

In summary, SHS reactions can be characterized as exothermic (ΔH<0) and spontaneous (ΔG<0).

One class of materials that can be produced using SHS is "in situ" metallic matrix composites. These are composites comprising a reinforcement phase, wherein the reinforcement phase directly participates in the SHS reaction. One such reaction can be described in its basic form as:

$$A+BY \rightarrow B+AY-\Delta H,$$

where "A" and "B" are metallic elements. Y is a non-metallic element, including, for example, boron, carbon, nitrogen or oxygen. "BY" and "AY" are chemical compounds containing at least one metallic element and at least one non-metallic element and "AY" is the in situ formed reinforcement phase. This reaction can be characterized by the element "B" appearing in its pure elemental form, which does not react with chemical compound "A". The resulting heat of the reaction (ΔH) can be given by:

$$\Delta H=\Delta_f H_{AY}-\Delta_f H_{BY}.$$

The change in Gibbs free energy (ΔG) can given by:

$$\Delta G=\Delta_f G_{AY}-\Delta_f G_{BY}.$$

One particular example of a material in the metallic matrix composite class of materials which can be produced using SHS, is a titanium aluminide alloy matrix composite with an in situ formed aluminum oxide reinforcement phase. The basic chemical formula for the formation of this alloy metallic matrix composite can be described as follows:

$$7Al+3TiO_2 \rightarrow 3TiAl+2Al_2O_3$$

In accordance with the foregoing formula, it is known to the art that the performance of an SHS reaction to form a titanium aluminide matrix composite comprising an aluminum oxide reinforcement phase, involves the use of 7 molar equivalents aluminum and 3 molar equivalents titanium dioxide as reactants, in order to obtain a matrix composite product comprising 3 molar equivalents of titanium aluminide alloy matrix reinforced by 2 molar equivalents of aluminum oxide. It is noted that in this particular SHS reaction peak temperatures can exceed 1,400° C.

One of the significant limitations of the SHS synthesis processes known to the art for the formation of titanium aluminide matrix composites, is that they yield materials that can exhibit substantial porosity, as disclosed in, for example, United States Patent Publication No. 2006/0032558. The presence of porosity negatively affects the material properties of the composites. In particular, titanium aluminide alloy matrix composites having porosity levels below 2% have heretofore been unattainable.

One set of techniques that has evolved to reduce the material porosity of titanium aluminide matrix composite compounds involves the application of pressure on the material during the SHS reaction. However drawbacks associated with the performance of these known techniques remain. Notably, under pressure the residual stress of the material post synthesis is very high, and increases even further during material cooling as a result of coefficient of thermal expansion (CTE) mismatch between the two phases.

Furthermore, the high-temperature strength of the titanium aluminide phase is low. Thus, catastrophic material failure is frequently observed as a result of either the compressive stress exceeding the high temperature strength of the titanium aluminide matrix, or the residual stress exceeding the high temperature strength of the titanium aluminide matrix during material cooling.

There remains therefore a need in the art for improved titanium aluminide matrix composites. In particular, there is a need in the art for a low porosity, high strength titanium aluminide alloy matrix composite which is formed using SHS, and which is capable of withstanding both compressive stress and residual stress for a period of time sufficient long until the material can be cooled and the stress relieved without catastrophic material failure.

SUMMARY

The following paragraphs are intended to introduce the reader to the more detailed description that follows and not to define or limit the claimed subject matter.

The present disclosure relates to metallic matrix composite materials and methods of making the same. The present disclosure further relates to titanium aluminide alloys reinforced by aluminum oxide, also known as titanium aluminide alloy matrix composites.

In an aspect of the present disclosure, a metallic matrix composite can comprise: a titanium aluminide alloy matrix; and an in situ formed aluminum oxide reinforcement, wherein the titanium aluminide alloy matrix comprises at least two titanium aluminide phases, and wherein the atomic percentage of aluminum in the titanium aluminide alloy matrix ranges from 40.0% to 48.0%.

At least one of the titanium aluminide phases can consist substantially of TiAl. At least one of the titanium aluminide phases can consist substantially of $Ti_3Al$. The weight percentage of $Ti_3Al$ can range from 9.02% to 43.17%.

At least one of the titanium aluminide alloy phases can consist substantially of TiAl, and at least one of the titanium aluminide alloy phases can consist substantially of $Ti_3Al$.

Quantities of the titanium aluminide phases in the form of TiAl and $TiAl_3$ and the aluminum oxide phase in the form of $Al_2O_3$ can be selected in molar equivalents in accordance with the following formula:

$$3(1-2x)TiAl+3xTi_3Al+2(1+x)Al_2O_3$$

wherein x ranges from 0.04 to 0.20. The quantity of TiAl can range from 1.8 to 2.76 molar equivalents, the quantity of $Ti_3Al$ can range from 0.12 to 0.6 molar equivalents, and the quantity of $Al_2O_3$ can range from 2.08 to 2.4 molar equivalents.

The metallic matrix composite can comprise at least one alloying element selected from the group consisting of boron, carbon, chromium, manganese, silicon, vanadium, and any combination thereof.

The metallic matrix composite can have a porosity of about 2% or less, or about 1% or less.

The metallic matrix composite can be used in an article of manufacture. The article of manufacture can be selected from the group consisting of an automotive part, an aeronautical part, and an armory part.

In an aspect of the present disclosure, a method of making a metallic matrix composite is provided. The metallic matrix composite can comprise a titanium aluminide alloy matrix, and an in situ formed aluminum oxide reinforcement, wherein the titanium aluminide alloy matrix comprises at least two titanium aluminide phases, and wherein the atomic percentage of aluminum in the titanium aluminide alloy matrix ranges from 40.0% to 48.0%. The method can comprise: providing a mixture of reactant aluminum and titanium dioxide in off-stoichiometric quantities; heating the mixture to cause the aluminum to react with the titanium dioxide in an exothermic reaction; and cooling the mixture to obtain the metallic matrix composite.

The step of providing can comprise providing the reactant aluminum and titanium dioxide as particulates. The step of providing can comprise compacting the particulates. The step of providing can comprise heating the particulates prior to or during the compacting.

The step of providing can comprise selecting quantities of the reactant aluminum and titanium dioxide in molar equivalents in accordance with the following formula:

$$3(1-2x)TiAl+3xTi_3Al+2(1+x)Al_2O_3,$$

wherein x ranges from 0.04 to 0.20. The method can comprise selecting the quantity of aluminum to range from 7.04 to 7.20 molar equivalents, and the quantity of titanium dioxide to range from 3.12 to 3.6 molar equivalents.

The method can comprise adding at least one alloying element to the metallic matrix composite selected from the group consisting of boron, carbon, chromium, manganese, silicon, vanadium, and any combination thereof.

The step of heating can comprise heating the mixture to a first temperature to cause melting of substantially all of the aluminum in the mixture. The first temperature can be greater than 660° C. The step of heating can comprise heating the mixture to a second temperature to initiate the exothermic reaction. The second temperature can be greater than 800° C. The step of heating can comprise permitting the mixture to reach at least an α-transus temperature of the mixture during the exothermic reaction. The method can comprise permitting the mixture to reach more than 1,125° C. during the exothermic reaction.

A metallic matrix composite can made in accordance with the methods described herein. Porosity of the metallic matrix composite can be about 2% or less, or about 1% or less. The metallic matrix composite can be used in an article of manufacture. The article of manufacture can be selected from the group consisting of an automotive part, an aeronautical part, an armory part.

Other features and advantages of the present disclosure will become apparent from the following detailed description. It should be understood, however, that the detailed description, while indicating preferred embodiments of the disclosure, are given by way of illustration only, since various changes and modifications within the spirit and scope of the disclosure will become apparent to those of skill in the art from the detailed description.

BRIEF DESCRIPTION OF THE DRAWINGS

The drawings included herewith are for illustrating various examples of apparatuses and methods of the present disclosure and are not intended to limit the scope of what is taught in any way. In the drawings:

FIG. 2A shows the phase diagram between T=600° C. and T=1,800° C. The graph shows which phases are expected to be in equilibrium at varying temperatures as a function of varying quantities of aluminum, expressed as an atomic percentage. The atomic percentage aluminum between 40% and 48% is highlighted in grey. FIG. 2B is an enlarged view of the area marked 2B in FIG. 2A. The α-transus temperature (Tα) for a given atomic percentage of aluminum can be determined with reference to line X-Y and the temperature scale in FIG. 2A. Thus, for example, the Tα at an atomic percentage of 40% aluminum is approximately 1,125° C. (see: arrows, FIG. 2A).

DETAILED DESCRIPTION

Figure 1:
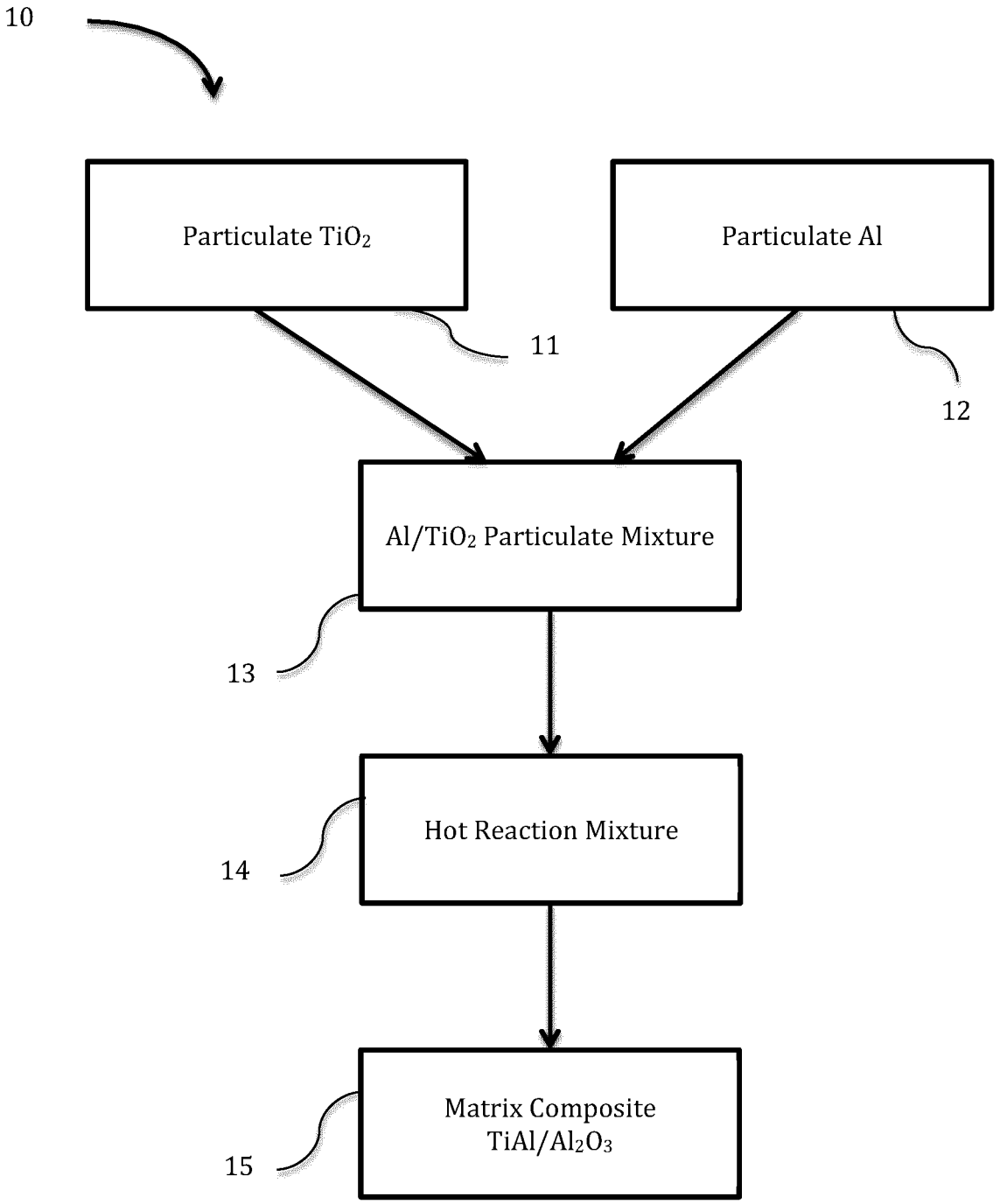
FIG. 1 is a schematic block diagram illustrating an example of a method for preparing a matrix composite comprising a titanium aluminide alloy phase and an in situ formed aluminum oxide phase.

Various apparatuses, methods or compositions will be described below to provide an example of an embodiment of each claimed invention. No embodiment described below limits any claimed invention and any claimed invention may cover apparatuses, methods and compositions that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Terms and Definitions

As used herein and in the claims, the singular forms, such "a", "an" and "the" include the plural reference and vice versa unless the context clearly indicates otherwise. Throughout this specification, unless otherwise indicated, "comprise", "comprises" and "comprising" are used inclusively rather than exclusively, so that a stated integer or group of integers may include one or more other non-stated integers or groups of integers.

The term "or" is inclusive unless modified, for example, by "either".

When ranges are used herein for physical properties, such as molecular weight, or chemical properties, such as chemical formulae, all combinations and sub-combinations of ranges and specific embodiments therein are intended to be included. Other than in the operating examples, or where otherwise indicated, all numbers expressing quantities of ingredients or reaction conditions used herein should be understood as modified in all instances by the term "about". The term "about" when referring to a number or a numerical range means that the number or numerical range referred to is an approximation within experimental variability (or within statistical experimental error), and thus the number or numerical range may vary between 1% and 15% of the stated number or numerical range, as will be readily recognized by context. Furthermore, any range of values described herein is intended to specifically include the limiting values of the range, and any intermediate value or sub-range within the given range, and all such intermediate values and sub-ranges are individually and specifically disclosed (e.g., a range of 1 to 5 includes 1, 1.5, 2, 2.75, 3, 3.90, 4, and 5). Similarly, other terms of degree such as "substantially" and "approximately" as used herein mean a reasonable amount of deviation of the modified term such that the end result is not significantly changed. These terms of degree should be construed as including a deviation of the modified term if this deviation would not negate the meaning of the term it modifies.

Unless otherwise defined, scientific and technical terms used in connection with the formulations described herein shall have the meanings that are commonly understood by those of ordinary skill in the art. The terminology used herein is for the purpose of describing particular embodiments only, and is not intended to limit the scope of the present invention, which is defined solely by the claims.

The term "α-transus temperature" and the symbol "Tα", as may be used interchangeably herein with reference to titanium aluminide phases and alloys, refer to the temperature above which a titanium and aluminum mixture exists exclusively in a solid solution of the alpha-titanium crystalline form. When material is cooled from a temperature above the α-transus temperature to below the α-transus temperature, it passes from the alpha titanium phase field into a phase field in which the titanium does not exclusively exist in its alpha-titanium crystalline form.

The term "aluminum", as used herein, refers to the chemical element known by the name aluminum or aluminium in its elemental configuration.

The term "aluminum oxide", as used herein, refers to a chemical compound consisting of aluminum and oxygen and having the chemical formula of $Al_2O_3$.

The term "mixture" as used herein refers to a composition comprising at least two chemical constituents, such as two chemical compounds, or a chemical compound and a chemical element. The constituents of the mixture can be more or less homogenously distributed. The term, as used herein with respect to aluminum and particulate titanium dioxide, is intended to broadly include any mixture that comprises titanium dioxide and aluminum in any form or constitution. Mixtures can comprise solid compounds, for example particulate compounds, or liquid compounds or a combination of solid and liquid compounds.

The term "titanium aluminide", as used herein, refers to intermetallic chemical compounds consisting of titanium and aluminum, including, without limitation, in the form of compounds having the chemical formula TiAl, $Ti_3Al$, $TiAl_2$, $TiAl_3$, or $Ti_3Al_5$ or mixtures comprising two or more of the foregoing, and further including any crystal structure and superlattice crystal structure, including γ-TiAl.

The term "titanium dioxide", as used herein, refers to a chemical compound consisting of titanium and oxygen and having the chemical formula $TiO_2$.

Various chemical elements and chemical compositions can be referred herein interchangeably either by using one, two or three letter identifiers for chemical elements in accordance with the Periodic Table of Chemical Elements, or by using their full chemical name, such as: "boron" or "B", or "aluminum oxide" or "$Al_2O_3$".

All publications, patents and patent applications are herein incorporated by reference in their entirety to the same extent as if each individual publication, patent or patent application was specifically and individually indicated to be incorporated by reference in its entirety.

General Implementation

In a broad aspect, the present disclosure relates to metallic matrix composite materials, notably titanium aluminide alloys reinforced by aluminum oxide, also known as titanium aluminide alloy matrix composites.

The metal matrix composites of the present disclosure can be characterized by exhibiting minimal porosity. For example, the porosity of the composites of the present disclosure can be 2% or less, rendering the composites of the present disclosure particularly useful to prepare articles that require integrity when exposed to substantial stresses and forces.

The composites of the present disclosure can be manufactured by performing an exothermic chemical reaction. The reaction conditions can be controlled in such a manner that the titanium aluminide alloy composites of the present disclosure, once formed, experience surprisingly few catastrophic material failures. This is in contrast to composites known to the art, which, as a result of either compressive stress exceeding the high temperature strength of the titanium aluminide alloy matrix, or residual stress exceeding the high temperature strength of the titanium aluminide alloy matrix during material cooling, frequently fail. Thus, the manufacturing economics of the composites provided the present disclosure can be attractive.

Accordingly, the present disclosure provides, in some embodiments, a metallic matrix composite comprising a titanium aluminide alloy matrix, and an in situ formed aluminum oxide reinforcement, wherein the titanium aluminide alloy matrix comprises at least two titanium aluminide phases, and wherein the atomic percentage of aluminum in the titanium aluminide alloy matrix ranges from 40.0% to 48.0%.

In some embodiments, the atomic percentage aluminum in the alloy can be 40%.

In some embodiments, the atomic percentage aluminum in the alloy can range from 40% to 44%.

In some embodiments, the atomic percentage aluminum in the alloy can range from 40% to 42%.

In some embodiments, the atomic percentage aluminum in the alloy can range from 42% to 44%.

In some embodiments, the atomic percentage aluminum in the alloy can range from 40% to 41% or about 41%.

In some embodiments, the atomic percentage aluminum in the alloy can be 41% or about 41%.

In some embodiments, the atomic percentage aluminum in the alloy can range from 41% or about 41% to 42% or about 42%.

In some embodiments, the atomic percentage aluminum in the alloy can be 42% or about 42%.

In some embodiments, the atomic percentage aluminum in the alloy can range from 42% or about 42% to 43% or about 43%.

In some embodiments, the atomic percentage aluminum in the alloy can be 43% or about 43%.

In some embodiments, the atomic percentage aluminum in the alloy can range from 43% or about 43% to 44% or about 44%.

In some embodiments, the atomic percentage aluminum in the alloy can range from 44% to 48%.

In some embodiments, the atomic percentage aluminum in the alloy can range from 44% to 46%.

In some embodiments, the atomic percentage aluminum in the alloy can range from 46% to 48%.

In some embodiments, the atomic percentage aluminum in the alloy can be 44% or about 44%.

In some embodiments, the atomic percentage aluminum in the alloy can range from 44% or about 44% to 45% or about 45%.

In some embodiments, the atomic percentage aluminum in the alloy can be 45% or about 45%.

In some embodiments, the atomic percentage aluminum in the alloy can range from 45% or about 45% to 46% or about 46%.

In some embodiments, the atomic percentage aluminum in the alloy can be 46% or about 46%.

In some embodiments, the atomic percentage aluminum in the alloy can range from 46% or about 46% to 47% or about 47%.

In some embodiments, the atomic percentage aluminum in the alloy can be 47% or about 47%.

In some embodiments, the atomic percentage aluminum in the alloy can range from 47% or about 47% to 48%.

In some embodiments, the atomic percentage aluminum in the alloy can be 48%.

In some embodiments, the alloy can comprise a titanium aluminide phase in the form of TiAl.

In some embodiments, the metallic matrix composite can comprise a titanium aluminide alloy phase in the form of $Ti_3Al$.

In some embodiments, the metallic matrix composite can comprise or consist of a titanium aluminide phase in the form of TiAl, but is substantially free of $Ti_3Al$.

In some embodiments, the alloy can comprise titanium aluminide phases in the form of TiAl and $Ti_3Al$.

In some embodiments, the alloy can comprise a titanium aluminide phase in the form or $Ti_3Al$, wherein the weight percentage of $Ti_3Al$ can range from 9.02% to 43.17%.

In some embodiments, the weight percentage (wt %), and corresponding molar equivalents (mol) of $Ti_3Al$, and the atomic percentage (at %) of aluminum in the alloy can be as specified in Table 1.

TABLE 1

| | | | | | | | | | |
|---|---|---|---|---|---|---|---|---|---|
| Al (at %) | 40.0 | 41.0 | 42.0 | 43.0 | 44.0 | 45.0 | 46.0 | 47.0 | 48.0 |
| $Ti_3Al$ (wt %) | 43.17 | 39.06 | 34.91 | 30.71 | 26.26 | 22.17 | 17.83 | 13.45 | 9.02 |
| $Ti_3Al$ (mol) | 0.6 | 0.54 | 0.48 | 0.43 | 0.36 | 0.30 | 0.24 | 0.18 | 0.12 |

In some embodiments, metallic matrix composites of the present disclosure can comprise molar equivalents of titanium aluminide in the form of TiAl and $TiAl_3$, and molar equivalents of $Al_2O_3$ in accordance with the following formula:

$$3(1-2x)TiAl+3xTi_3Al+2(1+x)Al_2O_3$$

wherein x ranges from 0.04 to 0.20.

In some embodiments, x is 0.20.

In some embodiments, x is 0.18 or about 0.18.

In some embodiments, x is 0.16 or about 0.16.

In some embodiments, x is 0.14 or about 0.14.

In some embodiments, x is 0.12 or about 0.12.

In some embodiments, x is 0.10 or about 0.10.

In some embodiments, x is 0.08 or about 0.08.

In some embodiments, x is 0.06 or about 0.06.

In some embodiments, x is 0.04.

In some embodiments, metallic matrix composites of the present disclosure can comprise: from 1.8 to 2.76 molar equivalents of TiAl; from 0.12 to 0.6 molar equivalents of $Ti_3Al$; and from 2.08 to 2.4 molar equivalents of $Al_2O_3$.

In some embodiments, metallic matrix composites of the present disclosure can include additional alloying elements, including, but not limited to, one or more of boron (B), carbon (C), chromium (Cr), manganese (Mn), silicon (Si) and vanadium (V).

In some embodiments, the porosity of the metallic matrix composites can be about 2% or less.

In some embodiments, the porosity of the metallic matrix composites can be about 1% or less.

In some embodiments, the porosity of the metallic matrix composites can be about 2%, 1.9%, 1.8%, 1.7%, 1.6%, 1.5%, 1.4%, 1.3%, 1.2%, 1.1%, 1.0%, 0.9%, 0.8%, 0.7%, 0.6%, 0.5%, 0.4%, 0.3%, 0.2% or 0.1%.

In order to make the composite of the present disclosure an exothermic reaction using aluminum and titanium dioxide as reactants can be performed. Accordingly, the present disclosure provides, in some embodiments, a method of making a metallic matrix composite, the metallic matrix composite comprising a titanium aluminide alloy matrix, and an in situ formed aluminum oxide reinforcement, wherein the titanium aluminide alloy matrix comprises at least two titanium aluminide phases, and wherein the atomic percentage of aluminum in the titanium aluminide alloy matrix ranges from 40.0% to 48.0%. In some embodiments, the method comprises: providing a mixture of reactant aluminum and titanium dioxide in off-stoichiometric quantities; heating the mixture to cause the aluminum to react with the titanium dioxide in an exothermic reaction; and cooling the mixture to obtain the metallic matrix composite.

Referring now to FIG. 1, a method 10 is shown for preparing a metallic matrix composite 15 comprising a titanium aluminide alloy with an in situ formed aluminum oxide phase. The method 10 can comprise a first step comprising providing and mixing particulate aluminum 12, with particulate titanium dioxide 11, wherein the particulate aluminum 12 and the particulate titanium dioxide 11 are provided in off-stoichiometric quantities, to form a particulate mixture 13 comprising particulate aluminum and particulate titanium dioxide. The method 10 can next comprise a second step comprising increasing the temperature of the particulate mixture 13 to a temperature sufficiently high to cause the aluminum to react with the titanium dioxide in an exothermic reaction and obtain a hot reaction mixture 14, and wherein in the chemical reaction titanium aluminide and aluminum oxide are formed. The method 10 can next comprise a third step, cooling the hot reaction mixture 14 to form the metallic matrix composite 15 comprising a titanium aluminide alloy matrix and an in situ formed aluminum oxide reinforcement.

To initiate the methods of the present disclosure, in some embodiments hereof, aluminum particles can be provided or obtained. In some embodiments, the aluminum particles can be provided in a more or less pure unalloyed elemental form, for example, industrial grade aluminum can be provided. Aluminum purity levels can vary somewhat but generally highly pure forms of aluminum are preferred, for example, substantially pure unalloyed aluminum, i.e. aluminum having a purity of about 99.9%, or about 99.99%. In other embodiments, aluminum is provided in the form of an aluminum alloy.

Alloying elements that can be used in accordance herewith include boron (B), carbon (C), chromium (Cr), manganese (Mn), silicon (Si) and vanadium (V). In some embodiments, the alloying elements can be provided in such amounts that the combined percentage of the alloying elements does not exceed about 10 percent by weight of the aluminum alloy. More preferably, alloying elements can be provided in such amounts that the combined percentage does not exceed about 3 percent by weight of the aluminum alloy.

In accordance with the present disclosure, the particle size of the particulate aluminum can vary. In some embodiments, the particle size of aluminum is substantially larger than the particle size of the particulate titanium dioxide. Particle size refers to the mean particle size of aluminum, or titanium dioxide, as the case may be. In some embodiments, aluminum particles can be selected to have a mean particle size larger than about 1 μm and smaller than about 100 μm, and more preferably between about 5 μm and about 20 μm. It is further preferred that the aluminum particles are selected to be homogenously sized, i.e. the particles have a tightly centered mean particle size, e.g., a particle size wherein 90% of the particles have a particle size not exceeding ±20% of the mean particle size, more preferably, not exceeding ±10%, and most preferably not exceeding ±5% of the mean particle size.

In some embodiments of the methods of the present disclosure, particulate titanium dioxide can be provided or obtained. In some embodiments, titanium dioxide is provided in the form of more or less pure titanium dioxide in particulate form, for example, industrial grade titanium dioxide. Purity levels of the titanium dioxide particles can vary but are preferably at least about 98%. The titanium dioxide particles can be provided in any mineral form. Mineral forms that can be used include, for example, anatase, rutile or brookite; however titanium dioxide compositions comprising minimally about 95% rutile form are preferably used, more preferably minimally about 98% rutile form, and most preferably about 100% rutile form. The size of the titanium dioxide particles can vary, however, as hereinbefore noted, in some embodiments the titanium dioxide particle size is selected to be substantially smaller than the aluminum particle size. In some embodiments, the mean titanium dioxide particle size can be at least 10×, at least 20×; at least 25× or at least 50× smaller than the mean aluminum particle size. In some embodiments, titanium dioxide particles are selected to have a mean particle size larger than about 0.1 μm and smaller than about 1 μm, and more preferably between about 0.3 μm and about 0.4 μm. It is further preferred, that the titanium dioxide particles are selected to be homogenously sized, i.e. the particles preferably have a tightly centered mean particle size, e.g., a particle size wherein 90% of the particles have a particle size not exceeding ±20% of the mean particle size, more preferably not exceeding ±10%, and most preferably not exceeding ±5% of the mean particle size.

Next, the aluminum particles and titanium dioxide particles can be contacted and mixed. In accordance herewith, the relative amounts of aluminum and titanium dioxide used to prepare the mixture can vary, provided however, that the amounts of aluminum and titanium dioxide are provided in off-stoichiometric quantities, with reference to the chemical reaction (I):

$$7Al+3TiO_2 \rightarrow 3TiAl+2Al_2O_3 \quad \text{(I).}$$

In some embodiments, the molar equivalents of aluminum and titanium dioxide reactants used to synthesize the metallic matrix composite can range in accordance with the following formula:

$$(7+x)Al+3(1+x)TiO_2 \rightarrow 3(1-2x)TiAl+3xTi_3Al+2(1+x)Al_2O_3,$$

wherein x ranges from 0.04 to 0.20.

In some embodiments, the molar equivalents of aluminum used can range from 7.04 molar equivalents to 7.20 molar equivalents, and the molar quantities of titanium dioxide can range from 3.12 molar equivalents to 3.60 molar equivalents.

In some embodiments, the amounts of reactant aluminum and titanium dioxide set forth in Table 2 can be used.

TABLE 2

| | | | | | | | | | |
|---|---|---|---|---|---|---|---|---|---|
| Al (mol) | 7.20 | 7.18 | 7.16 | 7.14 | 7.12 | 7.10 | 7.08 | 7.06 | 7.04 |
| $TiO_2$ (mol) | 3.60 | 3.54 | 3.48 | 3.42 | 3.36 | 3.30 | 3.24 | 3.18 | 3.12 |

In some embodiments, the particulate aluminum, or optionally aluminum alloy, can be contacted with the particulate titanium dioxide and the particles can be mixed or blended to obtain a more or less homogenous mixture comprising aluminum and titanium dioxide particles. A mechanical device, for example, a mechanical milling device, e.g., a ball mill, can be used to mix the particulates. In addition, in some embodiments, in order to facilitate mixing of particles, the particles can be coated, for example with a solvent, such as acetone.

Contacting and mixing of the two particulates can be performed at room temperature. Mixing of aluminum with the titanium particles can be performed in any suitable container, including any container or vessel capable of withstanding the temperatures used in accordance herewith, thus facilitating subsequent heating of the particulate mixture. Such containers can include containers made of heat resistant material, for example porcelain, graphite or an inert metal.

In some embodiments, particulate aluminum and a particulate titanium dioxide can be blended and subsequently compacted. Such compacting can be achieved using a mechanical press die, i.e. a metal sleeve for holding the powder mixture and a cylinder that fits into the sleeve and is capable of pressing the powder. The amount of force applied can vary, but is at a minimum an amount of force sufficient to cause the particulate mixture to bind into a solid body. In this regard a force from, for example, about 1 MPa to about 1,000 MPa can be applied, using for example a hydraulic pressure device. In other embodiments, a pelletizing device can be used to compact the power into, for example, pellets or spheres. In some embodiments, the mixture can be compacted at room temperature. In other embodiments, the mixture can be compacted at an elevated temperature, for example by heating the mixture to, e.g., approximately 100° C., 200° C., 300° C., 350° C., or 400° C., and thereafter exerting pressure on the hot mixture.

Next, the particulate mixture can be heated. In order to perform an exothermic reaction, such as an SHS reaction, the temperature of the particulate mixture can be increased. In general, this involves heating the mixture to a first temperature in excess of the melting temperature of aluminum. Melting temperatures can vary somewhat, depending on, for example, whether unalloyed or alloyed aluminum is used, but are typically at least 660° C., or about 660° C. In some embodiments, the aluminum or aluminum alloy can be heated to a temperature of between 700° C. or about 700° C., in other embodiments to 800° C. or about 800° C., and in still other embodiments to a temperature of between 725° C. or about 725° C., and 775° C., or about 775° C., in order to obtain molten aluminum, or optionally an aluminum alloy.

In some embodiments, the temperature of the mixture can be increased to at least the melting temperature of aluminum, and the temperature and is maintained for a period at least sufficiently long to cause melting of all, or substantially all, of the aluminum present within the mixture. Thereafter the temperature of the mixture can be increased further to a second temperature sufficiently high to initiate an exothermic reaction between the reactants. The temperature to initiate the exothermic reaction can vary, but is generally a temperature higher than 800° C., e.g., about 825° C., 850° C. or about 900° C. It is noted that in particular when very small aluminum particles are used the temperature sufficient to initiate an exothermic reaction can be close to the melting temperature of aluminum, implying that the exothermic reaction can occur when the temperature of the reaction mixture is raised above 660° C. In order to heat the particulate mixture any suitable heating device or process may be used, e.g., a metallurgical furnace or heating oven.

In some embodiments, the herewith practiced reaction conditions can be established to permit the temperature of the reaction mixture to reach at least the α-transus temperature (Tα), for example, a temperature between about 1,125° C. and 1,400° C., however temperatures as high as 2,000° C. can be reached. It is noted that chemical reaction (I) represents an exothermic chemical reaction having a $\Delta H_r$ of −627 kJ/mol, resulting in the release of energy in the form of heat, thus the temperature of the mixture can increase well above the temperature that can be delivered by an external heat source, such as a furnace.

Figure 2A:
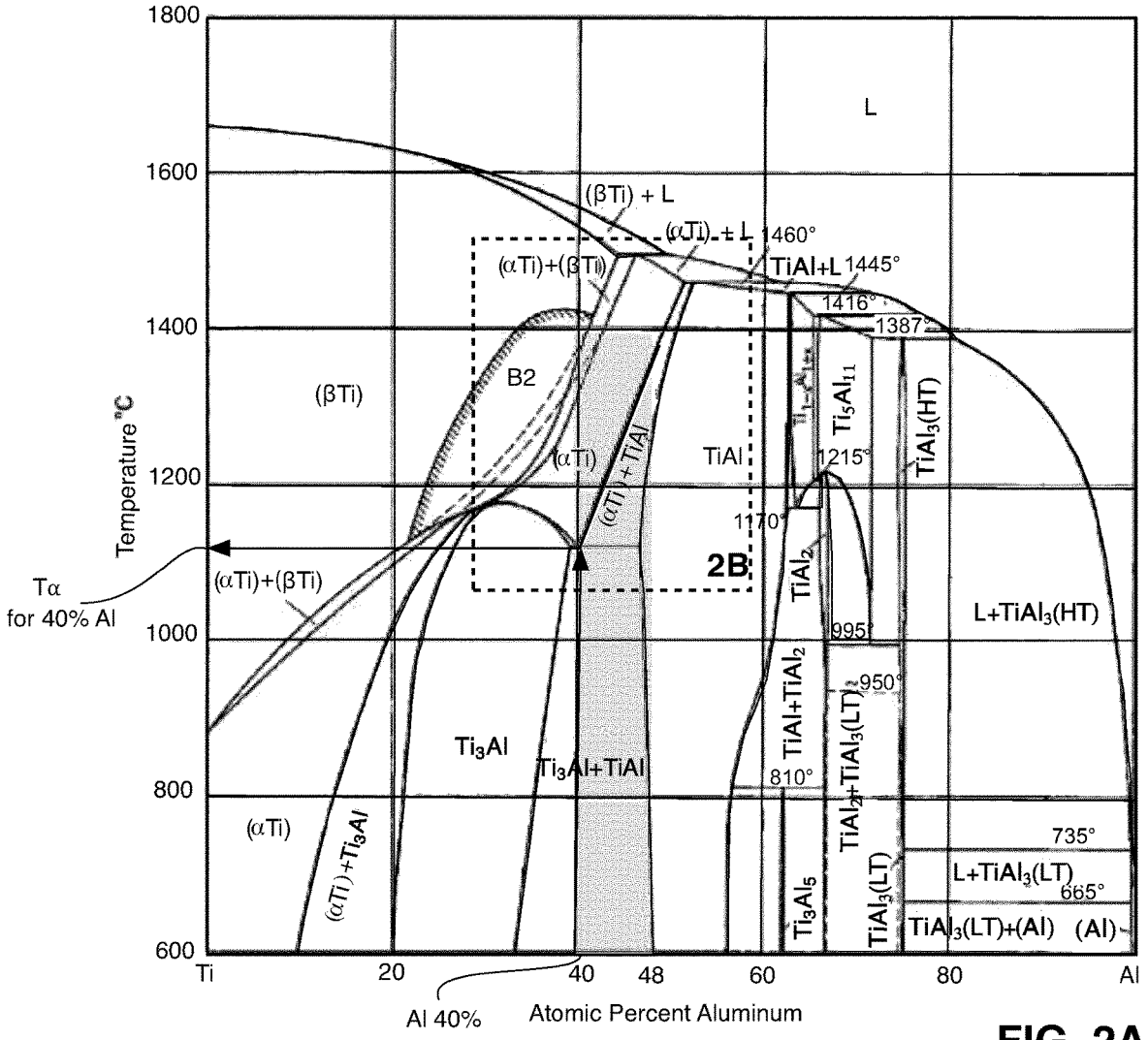
FIGS. 2A and 2B are graphs representing portions of a titanium aluminide binary phase diagram.
Figure 2B:
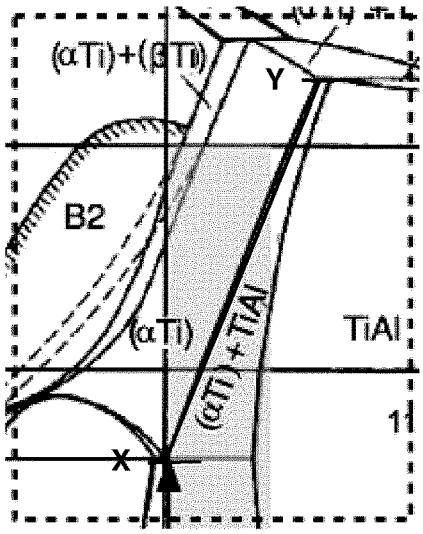

Referring now to FIGS. 2A and 2B, shown therein is an example phase diagram and the Tα (see: line X-Y in FIG. 2B) for a titanium aluminide composite having various atomic percentages of aluminum, notably between 40% and 48%. From the example phase diagram (FIG. 2A), it can be determined that depending on the atomic percentage aluminum selected, in accordance with some embodiments, the reaction conditions can be established to permit the temperature of the mixture to reach at least between 1,125° C. (atomic percentage aluminum 40%) and 1,375° C. (atomic percentage aluminum 48%).

In some embodiments, the temperature of the reaction mixture can be increased under ambient or atmospheric pressure.

In some embodiments, the temperature of the reaction mixture can be increased under pressure in excess of ambient pressure, for example by exerting a pressure of at least on 1 MPa, at least 10 MPa, at least 100 MPa or at least 1,000 MPa on the mixture, using for example a hydraulic press.

Following the performance of the exothermic reaction, the formed material can be cooled, for example, below the Tα, and as the temperature of the material passes through the Tα, TiAl and $Ti_3Al$ can be formed and a solid composite comprising a titanium aluminide alloy phase and in situ formed aluminum oxide phase, more or less homogenously dispersed therein, can be obtained. The temperature of the material can then be brought down to ambient temperature. The occurrence of catastrophic material failure during the cooling of the metallic matrix composites of the present disclosure has been rarely observed.

Thus, it will be clear that the metallic matrix composites of the present disclosure can be made by performing SHS reactions. The techniques used to conduct an SHS reaction in accordance herewith, including the arrangement of parts and tools, reaction conditions, details and order of operation can be varied. Some techniques to conduct SHS reactions that can be used, in accordance herewith, are detailed in U.S. Pat. No. 4,916,029 (Nagle et al.), U.S. Pat. No. 5,059,490 (Brupbacher et al.), and U.S. Pat. No. 6,955,532 (Zhu et al.), PCT Patent Publication No. WO 02/053316 (Lintunen et al.), and Horvitz et al., 2002, J. European Ceramic Society 22, 947-954, as well as the techniques described in U.S. Patent Application Nos. 62/331,507, 62/331,526 and/or 62/331,570, or any patent applications or patents deriving priority therefrom.

The quantities of TiAl and $Ti_3Al$ and in situ formed $Al_2O_3$ can vary as a function of the atomic percentage of aluminum, as hereinbefore noted in accordance with the following formula:

$$3(1-2x)TiAl+3xTi_3Al+2(1+x)Al_2O_3,$$

wherein x ranges from 0.04 to 0.20. Thus, in some embodiments, a composite of the present disclosure can comprise from 1.8 to 2.76 molar equivalents of TiAl; from 0.12 to 0.6 molar equivalents of $Ti_3Al$; and from 2.08 to 2.4 molar equivalents of $Al_2O_3$.

The solid composites of the present disclosure can be said to be characterized by having a very low porosity, notably about 2% or less for example, 1.9%, 1.8%, 1.7%, 1.6%, 1.5%, 1.4%, 1.3%, 1.2%, 1.1%, 1.0%, 0.9%, 0.8%, 0.7%, 0.6%, 0.5, 0.4%, 0.3%, 0.2% or 0.1%.

The composites of the present disclosure can be used to make a wide range of articles of manufacture, including articles of manufacture of any geometric dimensions, for example, by conducting the SHS reaction in a die of desired geometric dimensions.

Accordingly, the present disclosure further includes uses of metallic matrix composites to make an article of manufacture. In some embodiments, the article of manufacture can be an automotive part. In some embodiments, the article of manufacture can be an aeronautical part. In some embodiments, the article of manufacture can be an armory part.

As now can be appreciated, the methods described herein can be used to manufacture metallic matrix composites, wherein the composite has a very low porosity, i.e. 2% or less, and wherein the occurrence of catastrophic failure is rare.

Of course, the above described example embodiments of the present application are intended to be illustrative only and in no way limiting. The described embodiments are susceptible to many modifications of form, arrangement of parts, details and order of operation. The present disclosure, rather, is intended to encompass all such modifications within its scope, as defined by the claims, which should be given a broad interpretation consistent with the description as a whole.

The above disclosure generally describes various aspects of methods and compositions of the present disclosure. A more complete understanding can be obtained by reference to the following specific examples. These examples are described solely for the purpose of illustration and are not intended to limit the scope of the disclosure. Changes in form and substitution of equivalents are contemplated as circumstances might suggest or render expedient. Although specific terms have been employed herein, such terms are intended in a descriptive sense and not for purposes of limitation.

EXAMPLES

Example 1—Matrix Composition Ti-46.5Al

An experiment was conducted with the objective of producing a metallic matrix composite comprising a titanium aluminide alloy matrix and an in situ formed aluminum oxide reinforcement, with the alloy comprising a TiAl phase and a $Ti_3Al$ phase, wherein the atomic percentage of aluminum in the alloy is 46.5%. The formulation of reactant materials needed to achieve the desired composition was determined using:

$$(7+x)Al+3(1+x)TiO_2 \rightarrow 3(1-2x)TiAl+3xTi_3Al+2(1+x)Al_2O_3,$$

where x equals 0.07, which yields:

$$7.07Al+3.21TiO_2 \rightarrow 2.58TiAl+0.21Ti_3Al+2.14Al_2O_3.$$

According to this equation, the titanium aluminide alloy matrix resulting from this formulation and produced by the reaction is estimated to contain a total atomic percent of aluminum of 46.5%, and 15.65% $Ti_3Al$ phase by weight.

Accordingly, 426.6 g of aluminum powder with a mean size of 6 μm was blended with 573.4 g of titanium dioxide powder (98% rutile) with a mean particle size of 0.35 μm, in a 5 l jar mill containing 750 ml of acetone and 500 g aluminum oxide balls (also known as milling media) of 1 cm in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150° C. After drying, the mixture was passed through a course sieve to remove the milling media, and then passed through a sieve with a screen size of −325 mesh in order to breakup any agglomerates and stored in a sealed container.

To make the preform, 60 g of the powder mixture was placed in a cylindrical compacting tool with a diameter of 50.8 mm, and subjected to an applied stress in the direction of the cylinder axis of 28 MPa for a time of 3 minutes. The preform was then removed from the compacting tool and placed in a tunnel furnace with an argon atmosphere at 720° C. for 1 hour. The preform was then removed from the tunnel furnace and placed in a vertical hydraulic press inside a steel tool heated to 720° C., with the axis of the preform cylinder parallel to the axis of the press. A stress of 90 MPa was then applied to the heated tool and preform for a period of 6 seconds, during which time the reaction was activated and the reactant product (the titanium aluminide matrix composite) was further compacted to form a titanium aluminide alloy matrix composite disc.

Immediately following compaction, the tool was opened and the disc was removed, covered with aluminum silicate fiber insulation, and allowed to cool to room temperature. Notably, the disc was intact upon removal, and remained intact while cooling to room temperature. The density of the titanium aluminide alloy matrix composite was measured and found to be 3.940 g/cm$^3$, with porosity of 0.4% when compared to the theoretical density of 3.956 g/cm$^3$ for the composite.

Example 2—Matrix Composition Ti-44Al

An experiment was conducted with the objective of producing a metallic matrix composite comprising a titanium aluminide alloy matrix and an in situ formed aluminum oxide reinforcement, with the alloy comprising a TiAl phase and a $Ti_3Al$ phase, wherein the atomic percentage of aluminum in the alloy is 44%. The formulation of reactant materials needed to achieve the desired composition was determined using:

$$(7+x)Al+3(1+x)TiO_2 \rightarrow 3(1-2x)TiAl+3xTi_3Al+2(1+x)Al_2O_3,$$

where x equals 0.12, which yields:

$$7.12Al+3.36TiO_2 \rightarrow 2.28TiAl+0.36Ti_3Al+2.24Al_2O_3.$$

According to this equation, the titanium aluminide alloy matrix resulting from this formulation and produced by the reaction is estimated to contain a total atomic percent of aluminum of 44%, and 26.46% $Ti_3Al$ phase by weight.

Accordingly, 417.2 g of aluminum powder with a mean size of 25 μm was blended with 582.8 g of titanium dioxide powder (98% rutile) with a mean particle size of 0.35 μm, in a 5 l jar mill containing 750 ml of acetone and 500 g aluminum oxide balls (also known as milling media) of 1 cm in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150° C. After drying, the mixture was passed through a course sieve to remove the milling media, and then passed through a sieve with a screen size of −325 mesh in order to breakup any agglomerates and stored in a sealed container.

To make the preform, 60 g of the powder mixture was placed in a cylindrical compacting tool with a diameter of 50.8 mm, and subjected to an applied stress in the direction of the cylinder axis of 28 MPa for a time of 3 minutes. The preform was then removed from the compacting tool and placed in a tunnel furnace with an argon atmosphere at 720° C. for 1 hour. The preform was then removed from the tunnel furnace and placed in a vertical hydraulic press inside a steel tool heated to 720° C., with the axis of the preform cylinder parallel to the axis of the press. A stress of 90 MPa was then applied to the heated tool and preform for a period of 6 seconds, during which time the reaction was activated and the reactant product (the titanium aluminide matrix composite) was further compacted to form a titanium aluminide alloy matrix composite disc.

Immediately following compaction, the tool was opened and the disc was removed, covered with aluminum silicate fiber insulation, and allowed to cool to room temperature. Notably, the disc was intact upon removal, and remained intact while cooling to room temperature. The density of the titanium aluminide alloy matrix composite was measured and found to be 3.956 g/cm$^3$, with porosity of 0.86% when compared to the theoretical density of 3.990 g/cm$^3$ for the composite.

Example 3—Matrix Composition Ti-50Al

An experiment was conducted with the objective of producing a metallic matrix composite comprising a titanium aluminide alloy matrix and an in situ formed aluminum oxide reinforcement, with the alloy comprising a TiAl phase and a $Ti_3Al$ phase, wherein the atomic percentage of aluminum in the alloy is 50%. The formulation of reactant materials needed to achieve the desired composition was determined using:

$$(7+x)Al+3(1+x)TiO_2 \rightarrow 3(1-2x)TiAl+3xTi_3Al+2(1+x)Al_2O_3,$$

where x equals 0, which yields:

$$7Al+3TiO_2 \rightarrow 3TiAl+2Al_2O_3.$$

According to this equation, the titanium aluminide alloy matrix resulting from this formulation and produced by the reaction is estimated to contain a total atomic percent of aluminum of 50%, and no $Ti_3Al$ phase.

Accordingly, 440.8 g of aluminum powder with a mean size of 6 μm was blended with 559.2 g of titanium dioxide powder (98% rutile) with a mean particle size of 0.35 μm, in a 5 l jar mill containing 750 ml of acetone and 500 g aluminum oxide balls (also known as milling media) of 1 cm in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150° C. After drying, the mixture was passed through a course sieve to remove the milling media, and then passed through a sieve with a screen size of −325 mesh in order to breakup any agglomerates and stored in a sealed container.

To make the preform, 60 g of the powder mixture was placed in a cylindrical compacting tool with a diameter of 50.8 mm, and subjected to an applied stress in the direction of the cylinder axis of 28 MPa for a time of 3 minutes. The preform was then removed from the compacting tool and placed in a tunnel furnace with an argon atmosphere at 720° C. for 1 hour. The preform was then removed from the tunnel furnace and placed in a vertical hydraulic press inside a steel tool heated to 720° C., with the axis of the preform cylinder parallel to the axis of the press. A stress of 90 MPa was then applied to the heated tool and preform for a period of 6 seconds, during which time the reaction was activated and the reactant product (the titanium aluminide matrix composite) was further compacted to form a titanium aluminide alloy matrix composite disc.

Immediately following compaction, the tool was opened and the disc was removed, covered with aluminum silicate fiber insulation, and allowed to cool to room temperature. Notably, the disc was intact upon removal, but failed catastrophically approximately 30 seconds after removal from the tool due to residual stress during cooling.

Example 4—Matrix Composition Ti-52Al

An experiment was conducted with the objective of producing a metallic matrix composite comprising a titanium aluminide alloy matrix and an in situ formed aluminum oxide reinforcement, with the alloy comprising a TiAl phase and a $Ti_3Al$ phase, wherein the atomic percentage of aluminum in the alloy is 52%. The formulation of reactant materials needed to achieve the desired composition was determined using:

$$(7+x)Al+3(1+x)TiO_2 \rightarrow [3(1+x)TiAl-6xAl]+2(1+x)Al_2O_3,$$

where x equals −0.04, and the aluminum (Al) product will be in the TiAl solid solution, which yields:

$$6.96Al+2.88TiO_2 \rightarrow [2.88TiAl+0.24Al]+1.92Al_2O_3.$$

According to this equation, the titanium aluminide alloy matrix resulting from this formulation and produced by the reaction is estimated to contain a total atomic percent of aluminum of 52%, no $Ti_3Al$ phase, and elemental aluminum in the titanium aluminide solid solution at an atomic percent of 2%.

Accordingly, 449.5 g of aluminum powder with a mean size of 6 μm was blended with 550.5 g of titanium dioxide powder (98% rutile) with a mean particle size of 0.35 μm, in a 5 l jar mill containing 750 ml of acetone and 500 g aluminum oxide balls (also known as milling media) of 1 cm in size, for 4 hours at a rotational speed of 275 revolutions per minute. After the 4 hours of milling, the acetone was removed from the mixture using a rotary evaporator until the mixture had the consistency of a paste. The mixture was then allowed to dry in a gravity convection oven for 24 hours at a temperature of 150° C. After drying, the mixture was passed through a course sieve to remove the milling media, and then passed through a sieve with a screen size of −325 mesh in order to breakup any agglomerates and stored in a sealed container.

To make the preform, 60 g of the powder mixture was placed in a cylindrical compacting tool with a diameter of 50.8 mm, and subjected to an applied stress in the direction of the cylinder axis of 28 MPa for a time of 3 minutes. The preform was then removed from the compacting tool and placed in a tunnel furnace with an argon atmosphere at 720° C. for 1 hour. The preform was then removed from the tunnel furnace and placed in a vertical hydraulic press inside a steel tool heated to 720° C., with the axis of the preform cylinder parallel to the axis of the press. A stress of 90 MPa was then applied to the heated tool and preform for a period of 6 seconds, during which time the reaction was activated and the reactant product (the titanium aluminide matrix composite) was further compacted to form a titanium aluminide alloy matrix composite disc.

Immediately following compaction, the tool was opened and the disc was removed, covered with aluminum silicate fiber insulation, and allowed to cool to room temperature. Notably, the disc had catastrophically failed in the tool prior to removal.

While the above description provides examples of one or more apparatuses, methods and/or compositions, it will be appreciated that the scope of the claims should not be limited by the preferred embodiments set forth in the examples, but should be given the broadest interpretation consistent with the description as a whole.

I claim:

1. A method of making a metallic matrix composite, the method comprising:

(a) providing a mixture of aluminum and titanium dioxide, wherein the providing step comprises selecting quantities of the aluminum and the titanium dioxide in molar equivalents in accordance with the following formula:

$$(7+x)\mathrm{Al}+3(1+x)\mathrm{TiO_2}\rightarrow 3(1-2x)\mathrm{TiAl}+3x\mathrm{Ti_3Al}+2(1+x)\mathrm{Al_2O_3},$$

wherein x ranges from 0.04 to 0.20, and wherein the providing step comprises blending the quantities of the aluminum and the titanium dioxide in accordance with the formula to provide the mixture;

(b) heating the mixture to cause the aluminum to react with the titanium dioxide in an exothermic reaction in accordance with the formula; and (c) cooling the mixture to obtain the metallic matrix composite, wherein the metallic matrix composite comprises a titanium aluminide alloy matrix, wherein the titanium aluminide alloy matrix comprises at least two titanium aluminide phases, wherein the atomic percentage of aluminum in the titanium aluminide alloy matrix is from 40.0% to 48.0%, wherein the titanium aluminide alloy matrix comprises a titanium aluminide phase in the form of $Ti_3Al$, and the weight percentage of $Ti_3Al$ in the titanium aluminide alloy matrix is from 9.02% to 43.17%, and wherein porosity of the metallic matrix composite is about 2% or less.

2. The method of claim 1, comprising selecting the quantity of aluminum to range from 7.07 to 7.12 molar equivalents, and the quantity of titanium dioxide to range from 3.21 to 3.36 molar equivalents.

3. The method of claim 1, comprising adding at least one alloying element to the metallic matrix composite selected from the group consisting of boron, carbon, chromium, manganese, silicon, vanadium, and any combination thereof.

4. The method of claim 1, wherein the step of heating comprises heating the mixture to a first temperature to cause melting of at least some of the aluminum in the mixture.

5. The method of claim 4, wherein the step of heating comprises heating the mixture to a second temperature to initiate the exothermic reaction.

6. The method of claim 1, wherein the step of heating comprises permitting the mixture to reach at least an α-transus temperature of the mixture during the exothermic reaction.

7. The method of claim 6, comprising permitting the mixture to reach more than 1,125° C. during the exothermic reaction.

8. The method of claim 4, wherein the first temperature is greater than 660° C.

9. The method of claim 5, wherein the second temperature is greater than 800° C.

10. The method of claim 1, wherein the porosity of the metallic matrix composite is about 1% or less.

11. The method of claim 1, wherein the atomic percentage of aluminum in the titanium aluminide alloy matrix is 40.0%, and the weight percentage of $Ti_3Al$ in the titanium aluminide alloy matrix is 43.17%.

12. The method of claim 1, wherein the atomic percentage of aluminum in the titanium aluminide alloy matrix is 44.0%, and the weight percentage of $Ti_3Al$ in the titanium aluminide alloy matrix is 26.26%.

13. The method of claim 1, wherein the atomic percentage of aluminum in the titanium aluminide alloy matrix is 48.0%, and the weight percentage of $Ti_3Al$ in the titanium aluminide alloy matrix is 9.02%.

14. A method, comprising:

(a) selecting quantities of aluminum and titanium dioxide in molar equivalents in accordance with the following formula:

$$(7+x)\mathrm{Al}+3(1+x)\mathrm{TiO_2}\rightarrow 3(1-2x)\mathrm{TiAl}+3x\mathrm{Ti_3Al}+2(1+x)\mathrm{Al_2O_3},$$

wherein x ranges from 0.04 to 0.20, (b) blending the quantities of the aluminum and the titanium dioxide in accordance with the formula to provide a mixture;

(c) heating the mixture to cause the aluminum to react with the titanium dioxide in accordance with the formula; and (d) cooling the mixture to obtain a metallic matrix composite, wherein the metallic matrix composite comprises a titanium aluminide alloy matrix, wherein the atomic percentage of aluminum in the titanium aluminide alloy matrix is from 40.0% to 48.0%, and wherein the titanium aluminide alloy matrix comprises a titanium aluminide phase in the form of $Ti_3Al$, and the weight percentage of $Ti_3Al$ in the titanium aluminide alloy matrix is from 9.02% to 43.17%.

15. The method of claim 14, comprising selecting the quantity of aluminum to range from 7.07 to 7.12 molar equivalents, and the quantity of titanium dioxide to range from 3.21 to 3.36 molar equivalents.

16. The method of claim 14, comprising adding at least one alloying element to the metallic matrix composite selected from the group consisting of boron, carbon, chromium, manganese, silicon, vanadium, and any combination thereof.

17. The method of claim 14, wherein the porosity of the metallic matrix composite is about 1% or less.

18. The method of claim 14, wherein the atomic percentage of aluminum in the titanium aluminide alloy matrix is 40.0%, and the weight percentage of $Ti_3Al$ in the titanium aluminide alloy matrix is 43.17%.

19. The method of claim 14, wherein the atomic percentage of aluminum in the titanium aluminide alloy matrix is 44.0%, and the weight percentage of $Ti_3Al$ in the titanium aluminide alloy matrix is 26.26%.

20. The method of claim 14, wherein the atomic percentage of aluminum in the titanium aluminide alloy matrix is 48.0%, and the weight percentage of $Ti_3Al$ in the titanium aluminide alloy matrix is 9.02%.

* * * * *